United States Patent [19]

Haep et al.

[11] 4,109,582

[45] Aug. 29, 1978

[54] TWIST-REDUCING RINGS FOR STABILIZED PROJECTILES

[75] Inventors: Heinz Haep, Dusseldorf; Georg Schumacher, Niederkruechten, both of Fed. Rep. of Germany

[73] Assignee: Rheinmetall GmbH, Dusseldorf, Fed. Rep. of Germany

[21] Appl. No.: 740,790

[22] Filed: Nov. 11, 1976

[30] Foreign Application Priority Data

Nov. 15, 1975 [DE] Fed. Rep. of Germany ..... 2551389

[51] Int. Cl.[2] ..... F42B 31/00

[52] U.S. Cl. ..... 102/93

[58] Field of Search ..... 102/38, 93, 94

[56] References Cited

U.S. PATENT DOCUMENTS

| | | | |
|---|---|---|---|
| 1,861,522 | 6/1932 | Brandt | 102/93 |
| 3,769,912 | 11/1973 | Friend | 102/93 |
| 3,882,777 | 5/1975 | Rausing | 102/38 R |

FOREIGN PATENT DOCUMENTS

| | | | |
|---|---|---|---|
| 1,093,020 | 11/1954 | France | 102/93 |
| 1,083,708 | 6/1960 | Fed. Rep. of Germany | 102/93 |
| 2,331,158 | 1/1975 | Fed. Rep. of Germany | 102/93 |

*Primary Examiner*—Verlin R. Pendegrass

[57] ABSTRACT

An improved construction and support for a twist-reducing ring carried on a stabilized projectile is described. The ring, which is rotatably supported in an annular groove in a portion of the projectile jacket, is formed from a plurality of circumferentially abutting, axially aligned powdered metal segments. Such segments, which are released upon separation of the projectile from the surrounding cartridge case, are initially retained in place either by the front wall of the cartridge or by a separate, easily destructible auxiliary ring. The ring segments are either directly rotatably engaged with the bottom wall of the annular groove, or are housed within a separate U-shaped container which, in turn is slidably mounted in the groove.

9 Claims, 4 Drawing Figures

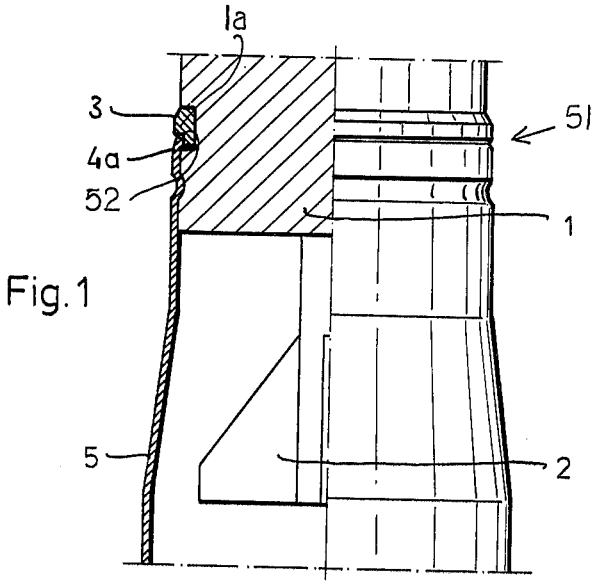
Fig. 1
Fig. 2
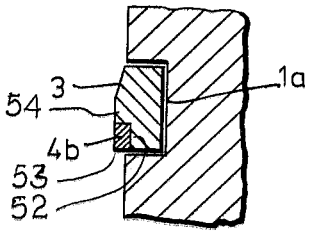
Fig. 3
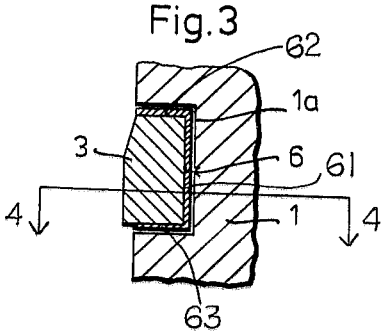
Fig. 4
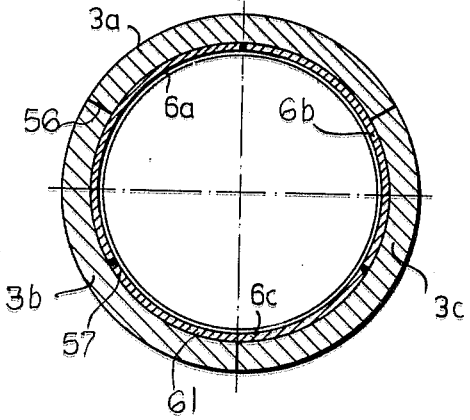

TWIST-REDUCING RINGS FOR STABILIZED PROJECTILES

BACKGROUND OF THE INVENTION

The invention relates to stabilized projectiles, and more particularly to such projectiles wherein a rotatably mounted ring assembly carried in an annular groove of the projectile jacket for reducing the spin ordinarily imparted to the projectile as the jacket thereof moves through the barrel of the firing weapon in contact with the barrel walls.

In known arrangements of this type, an accurately dimensioned, one-piece ring is initially placed within an annular groove of one of two separable halves of the projectile jacket, with the ring being supported for relative rotation in the associated groove. After the ring is so placed, the other projectile jacket half is assembled to the first half, so that the ring is effectively captured within the projectile during its flight. The outer periphery of the ring extends beyond the walls of the associated jacket halves to contact the inner wall of the barrel of the firing weapon during discharge, thereby to effect the desired twist-reducing function.

A disadvantage of such known arrangement is that the ring, being captured between the two mating halves of the projectile during the entire flight thereof to the target, forms part of the dead load of the projectile. In addition, the portion of the ring projecting past the wall of the jacket halves during flight significantly increases the air resistance. In addition, the necessity of providing a projectile made of two cooperating jacket halves for receiving the stabilizing ring results in a complex and expensive assembly.

SUMMARY OF THE INVENTION

Such disadvantages are overcome with an arrangement and mounting, in accordance with the invention, for a twist-reducing ring for applications of the above-mentioned type. In an illustrative embodiment, the ring is formed from a plurality of identical, axially aligned, circumferentially abutting first segments that cooperate to form a first annulus. Because of the segmented construction of the ring, the ring will separate from the jacket after separation of the projectile jacket from the surrounding cartridge case, so that the ring will neither form part of the dead load of the missile nor increase the air resistance thereof as in the prior art.

In order to retain the first segments together prior to the separation of the projectile from the cartridge, a releasable retainer is provided whereby, for example, the front wall of the cartridge is initially positioned over a recessed rear portion of the cooperating segments in engagement therewith. Alternatively, a separate auxiliary ring, which is destructible upon separation of the projectile from the cartridge, may be initially seated within the recessed rear portion of the first segments. The inner periphery of the cooperating first segments may be in direct rotatable contact with the bottom wall of the annular groove of the jacket, which jacket may advantageously have a one-piece construction in contrast to the expensive two-piece, split construction of the prior art. Alternatively, the first segments may be fixedly supported within a surrounding U-shaped container, whose central surface in turn is in rotating engagement with the bottom wall of the groove. The container itself may be formed from cooperating segments, with the interfaces between the latter segments being circumferentially staggered with respect to the interfaces between the overlying first segments of the stabilizing ring.

The first segments, which may be formed from a sinterable powdered metal, may either be pre-formed in the final segmental shape, or may be defined by a radical cut through a closed annular ring.

BRIEF DESCRIPTION OF THE DRAWING

The invention is further set forth in the following detailed description taken in conjunction with the appended drawing, in which:

FIG. 1 is a longitudinal view, partially in section, of a stabilized projectile having an arrangement and mounting for a twist-reducing ring in accordance with the invention, the projectile being shown supported within a cartridge case;

FIG. 2 is an enlarged sectional view of a modified portion of the ring-containing area of FIG. 1, illustrating an alternative method of temporarily retaining the twist-reducing ring within the projectile;

FIG. 3 is an enlarged sectional view of a modification of the ring-containing portion of FIG. 2, illustrating a composite ring construction including a U-shaped ring-holding container that is slidably mounted on the associated portion of the projectile jacket; and FIG. 4 is a transverse section taken along line 4—4 of FIG. 3.

DETAILED DESCRIPTION

Referring now to the drawing, a rear portion of a jacket 1 of a stabilized projectile 51 is shown disposed within and extending forwardly from a hollow cartridge shell 5. The tail portion of the jacket 1 is provided with a wing-type steering mechanism 2 of conventional construction.

Projectile 51 is selectively dischargeable, in a well-known manner, through the barrel of a firing weapon (not shown). During the passage of the projectile through the weapon barrel after separation from the cartridge shell, the contact of the peripheral wall of the shell jacket 1 with the barrel tends to set up undesired spin or twist of the projectile casing about its axis.

In order to reduce such twist, it has been customary to rotatably support a guide ring in an annular groove on the outer periphery of the shell jacket, with the ring extending beyond the wall of the jacket to contact the barrel of the firing weapon during the passage of the projectile therethrough. To assemble the ring (which has been of one-piece construction) to the projectile, the projectile has been made in two separable parts, with the ring seated in an annular groove of one of the parts and then captured when the other jacket half is assembled to the first half.

To avoid these problems, the improved ring construction and mounting illustrated in the drawing may be employed. The ring 3 is formed from three circumferentially abutting, axially aligned ring segments 3*a*, 3*b*, 3*c* (FIG. 4), which cooperate to form a closed annulus which is seated within an annular groove 1*a* of the projectile casing 1, which advantageously may be formed from one piece.

The resulting ring 3 is adapted to separate from the projectile when the jacket 1 leaves the muzzle of the firing weapon, so that unlike previous designs such ring will not form part of the dead load of the projectile, nor will it act to increase the air resistance on the projectile because of its overlapping nature, during the flight of the projectile to the target. In order to releasably secure the ring 3 within the groove 1*a* prior to firing, a front portion 4*a* of the shell cartridge 5 may axially overlap and engage corresponding rear portions 52 of the aligned segments forming the ring 3. With such arrangement, the initial separation of the projectile 51 from the cartridge 4 within the firing weapon will cause the ring 3 to be initially retained in engaging contact with the barrel of the weapon, and then separated from the projectile altogether when the projectile leaves the gun muzzle.

The inner periphery of the ring 1 is arranged in rotatable engagement with the radially inner walls of the ring 3. Depending upon the degree of twist reduction desired, the ring 3 may be arranged freely rotatable in the groove 1*a*, or alternatively may be arranged to initiate a rotation only after a certain friction between the ring 3 and the surrounding wall of the barrel of the firing weapon is exceeded.

An alternative technique for releasably retaining the segmented ring 3 within the jacket groove 1*a* is depicted in FIG. 2. In this case, an auxiliary ring 4*b*, which may be made of a material which is destructible upon the firing of the projectile out of the gun, is disposed around the rear portion 52 of the segmented ring 3. An outer periphery 53 of the auxiliary ring 4*b* is preferably disposed flush with the outer periphery (designated 54) of the main forward portion of the ring 3.

In FIGS. 3 and 4, the segmented ring 3 is shown fixedly secured within a generally U-shaped segmented container 6, which in turn is slidably mounted within the groove 1*a* of the projectile jacket 1.

Illustratively, the container 6 is formed of three identical U-shaped segments 6*a*, 6*b*, 6*c*, which like the superposed ring segments 3*a*–3*c* are arranged in circumferentially abutting relation to form a closed annulus. Respective interfaces 56 between adjacent ones of the ring segments 3*a*–3*c* are circumferentially offset from respective interfaces 57 between adjacent pairs of the container segments 6*a*–6*c*, so that each of such ring segments overlaps and effectively clamps two underlying ones of the container segments. The retaining arrangement of FIGS. 1 and 2 may, of course, be associated with the ring-container structure of FIGS. 3–4 to maintain the latter in place prior to the firing of the associated gun.

Each of the container segments 6 has a central surface 61, which is rotatably arranged on the underlying bottom surface of the groove 1*a*. A pair of radial legs or flanges 62, 63 extend outwardly from axially opposite ends of the central surface 61 to receive the corresponding axially opposite ends of the segmented ring 3.

Each of the ring segments 3*a*–3*c* may be formed by sintering a suitable powdered metal. The segments 3*a* may either be pre-formed in their final shape, or may form segments of a closed sintered metallic ring which has been cut through radially in corresponding portions after manufacture.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In a stabilized projectile having charge-carrying jacket means extending forwardly and separable from an associated cartridge, the jacket means having an annular groove on the outer periphery thereof, and twist-reducing ring means rotatably carried in the annular groove for relative rotation concentric with the axis of the projectile, the improvement wherein the twist-reducing ring means comprises a plurality of identical, axially aligned first ring segments disposed in circumferentially successive abutting relation, the first segments cooperating to form a first closed annulus; and in which the projectile further comprises means for removably retaining the cooperating first segments in the annular groove prior to separation of the jacket means from the cartridge.

2. A projectile as defined in claim 1, in which the retaining means comprises an opening front portion of the cartridge, the wall of such front portion axially overlapping and engaging a rear portion of the first annulus.

3. A projectile as defined in claim 1, in which the retaining means comprises an auxiliary destructible ring disposed in surrounding and engaging relation with a rear portion of the first annulus.

4. A projectile as defined in claim 1, in which the inner periphery of the first annulus is slidably mounted in the annular groove.

5. A projectile as defined in claim 1, in which the twist-reducing means further comprises an annular container for receiving and immobilizing the first annulus, the container having a generally U-shaped cross-section, the container comprising an axially extending central surface disposed radially intermediate the first annulus and the wall of the annular groove, the central surface being rotatably supported in the annular groove, and a pair of flanges extending radially outwardly from axially opposite ends of the central section.

6. A projectile as defined in claim 5, in which the container comprising a plurality of identical, axially aligned second segments disposed in circumferentially successive abutting relation and cooperating to form a second closed annulus.

7. A projectile as defined in claim 6, in which the interfaces between abutting pairs of the second segments are respectively circumferentially displaced from the interfaces between abutting pairs of the first segments, whereby each first segment effects a retaining action on the underlying two second segments.

8. A projectile as defined in claim 2, in which the outer periphery of the first annulus is radially recessed to align the outer diameter of the surrounding wall of the front portion of the cartridge and the outer periphery of the remaining portion of the first annulus.

9. A projectile as defined in claim 1, in which the first segments are formed from a sinterable powdered metal.

* * * * *